US007603992B2

(12) United States Patent
Chen

(10) Patent No.: US 7,603,992 B2
(45) Date of Patent: Oct. 20, 2009

(54) FUEL-SAVING APPARATUS

(76) Inventor: Edward I-Hua Chen, 12F, No. 51, Sec. 2, Changsha St., Taipei City (TW)

( * ) Notice: Subject to any disclaimer, the term of this patent is extended or adjusted under 35 U.S.C. 154(b) by 0 days.

(21) Appl. No.: 12/022,598

(22) Filed: Jan. 30, 2008

(65) Prior Publication Data

US 2009/0188474 A1 Jul. 30, 2009

(51) Int. Cl.
*F02M 27/00* (2006.01)

(52) U.S. Cl. ..... 123/538

(58) Field of Classification Search ..... 123/538
See application file for complete search history.

(56) References Cited

U.S. PATENT DOCUMENTS 5,460,144 A * 10/1995 Park et al. ..... 123/538
5,632,254 A * 5/1997 Kim ..... 123/538
5,660,764 A * 8/1997 Lu ..... 261/1
5,829,419 A * 11/1998 Sadkin et al. ..... 123/538
5,873,353 A * 2/1999 Makita ..... 123/538
6,026,788 A * 2/2000 Wey ..... 123/538
6,058,914 A * 5/2000 Suzuki ..... 123/538
6,082,339 A * 7/2000 Wey ..... 123/538
6,178,954 B1 * 1/2001 Kim ..... 123/538
7,066,156 B2 * 6/2006 Magyari ..... 123/538
7,100,583 B2 * 9/2006 Lu ..... 123/536
7,195,005 B2 * 3/2007 Yoshimoto ..... 123/538
7,281,526 B2 * 10/2007 Keiichiro et al. ..... 123/538
7,287,520 B2 * 10/2007 Hashimoto et al. ..... 123/538
7,377,269 B1 * 5/2008 Lai ..... 123/538
2008/0190401 A1 * 8/2008 Guo ..... 123/538

* cited by examiner

*Primary Examiner*—Stephen K Cronin
*Assistant Examiner*—David Hamaoui
(74) *Attorney, Agent, or Firm*—Apex Juris, pllc; Tracy M. Heims

(57) ABSTRACT

A fuel-saving apparatus includes an elongated and flattened body made from a pliable material. The body has two ends each has a coupling slot formed thereon, a plurality of openings formed on the surface thereof and a plurality of upper flanges and lower flanges formed at two lateral sides, and a base blade which has the surface attached to an infrared membrane. The base blade is wedged through the coupling slot and encased by the body. The body is disposed in a fuel tank without the flattened surface directly in contact with the inner wall of the fuel tank due to the upper and lower flanges. The base blade radiates infrared light through the openings to boost the energy level of fuel molecules in the fuel tank so that the fuel can achieve almost complete combustion.

4 Claims, 4 Drawing Sheets

FUEL-SAVING APPARATUS

FIELD OF THE INVENTION

The present invention relates to a fuel-saving apparatus and particularly to a fuel-saving apparatus disposed in a fuel tank to boost the energy level of fuel in the fuel tank to achieve complete combustion of the fuel in an engine.

BACKGROUND OF THE INVENTION

The price of crude oil soars significantly in recent years worldwide. Gasoline is more expensive. Almost all vehicle manufacturers devote a great deal of research and development trying to make vehicles more fuel economic. Moreover, business condition is lingering at a lower gear in the recent years. Most car users feel the burden heavier. Most of the domestic car plants have introduced fuel-saving cars, ranged from traditional sedans to sport utility vehicles. However, most of the cars, domestically made or imported, are medium or large sizes gas guzzlers. Some have a minimum mileage of four to five Km per liter of gas in city driving. Even the claimed fuel-saving ones rarely have mileage of six or seven Km per liter of gas. According to reports published by experts upon researches of many years, more than 80% of vehicles now on the market cannot achieve complete combustion of fuel. And fuel waste caused by this factor is more than 30%. Thus to achieve complete combustion of fuel is the fundamental issue to make an engine to generate horse power needed.

Therefore, in order to make the engine of vehicles to fully output power and achieve environmental protection and fuel-saving effect, getting complete combustion of gasoline is essential. When the gasoline is completely combusted carbon accumulation in the engine reduces, carbon content in the gasoline also is less and the power of the engine increases. Engine operation is smoother and acceleration is more effective. Discharge of toxic gases also is reduced proportionally. Thus fuel-saving and environmental protection can be achieved at the same time.

These days a wide variety of fuel-saving products are available on the market. Some are installed on the fuel piping such as magnetic products, infrared bonding blades, fuel tank caps, nanometer titanium crystals and the like. They mostly aim to atomize fuel (gasoline) to smaller molecules through a heating principle to achieve complete combustion. The techniques being adopted include: 1. using a magnetic element made of a rare-earth group that has a strong magnetic force to enhance fuel combustion efficiency; 2. atomizing fuel molecules in the piping to achieve complete combustion; 3. sending carbon hydrogen compounds generated by hydrogen and carbon of the gasoline through a strong magnetic field to rapidly discompose by catalyzing and regroup by magnetizing; 4. evenly bonding molecules of CH radicals with oxygen (into a complete combustion condition) to release the molecules otherwise to be wasted to increase oxygen content of the fuel to achieve complete combustion; 5. absorbing optical and thermal energy through an infrared product and generating infrared radiation heat to pre-heat and atomize gasoline molecules so that positive and negative ions in the gasoline are arranged in a desired manner to enrich the oxygen content and raise the combustion temperature.

However, the fuel-saving products installed on the fuel piping mostly are installed on a fuel supply tube close to the fuel injector. Some of them surround the piping, some are held in the piping, and the infrared products are attached to the exterior of cylinder. All of such approaches have drawbacks, such as: 1. installation is difficult and easily damages the vehicles; 2. magnetic degeneration takes place at high temperature for the magnetic products: the high temperature causes accelerated movement of molecules in the magnet and alters the current direction of the molecules and deranges the alignment of molecular polarity, and results in change of total magnetization and attenuation or loss thereof. Moreover, tests show that the magnetic fuel-saving device in the fuel piping is effective only at 5000 Gauss or higher for gasoline, and 6000 Gauss or higher for diesel fuel. This makes instantaneous treatment of the gasoline very difficult. Hence to achieve a desired fuel-saving effect more than one set of the devices have to be installed on the fuel pipe. 3. the infrared light has vibration frequency about 28,000 times per second with a reaction range less than one mm. The effect is not desirable, and achievable only to 5% and limited to old vehicles. The vibration can clear a small amount of accumulated carbon, thus can achieve some atomization effect. But the infrared product easily degenerates. 4. the fuel cap device is most effective only when the fuel tank is full.

Thus how to develop a fuel-saving apparatus that can be installed easily and render complete combustion of fuel and enhance smooth operation of the engine to achieve fuel-saving and environmental protection effects is an important issue at present remained to be resolved.

SUMMARY OF THE INVENTION

To solve the aforesaid problems, it is an object of the present invention to provide a fuel-saving apparatus that can be easily installed and boost the energy level of fuel through infrared light to achieve almost complete combustion.

The fuel-saving apparatus according to the invention includes an elongated and flattened body made from a pliable material. The body has two ends each has a coupling slot formed thereon. The flattened body further has a plurality of openings formed thereon and a plurality of upper flanges and lower flanges formed at two lateral sides, and a base blade which has the surface attached to an infrared membrane. The base blade is wedged through the coupling slot. The body is disposed in a fuel tank without the flattened surface thereof directly in contact with the inner wall of the fuel tank due to the upper and lower flanges. The base blade radiates infrared light through the openings to boost the energy level of fuel molecules in the fuel tank so that the fuel can achieve almost complete combustion.

The two ends of the body further have respectively an extended portion from a lower side of the coupling slot. The extended portion has a detent ridge on the surface to prevent the base blade from sliding out through the coupling slot. One of the extended portions further has a protrusive hanging portion with a hanging hole formed thereon to hang the body in the fuel tank through an external article.

The base blade may include a plurality of smaller base blades mating the pliable body so that the body and the smaller base blades are bendable to suit different fuel inlets of the fuel tank.

By incorporating the body and the base blade attached to the infrared membrane on the surface, and with the body and base blade held in the fuel tank and bendable, the invention can be easily installed in any type of fuel tanks. The flattened surface of the body does not directly in contact with the inner wall of the fuel tank due to the upper and lower flanges. The base blade can radiate infrared light through the openings of the body so that the energy level of the fuel molecules can be boosted. As a result an almost complete combustion can be achieved for the fuel in the engine to make fuel-saving possible.

The foregoing, as well as additional objects, features and advantages of the invention will be more readily apparent from the following detailed description, which proceeds with reference to the accompanying drawings. The embodiments discussed below serve only illustrative purpose, and are not the limitation of the invention.

DETAILED DESCRIPTION OF THE PREFERRED EMBODIMENTS

Figure 1:
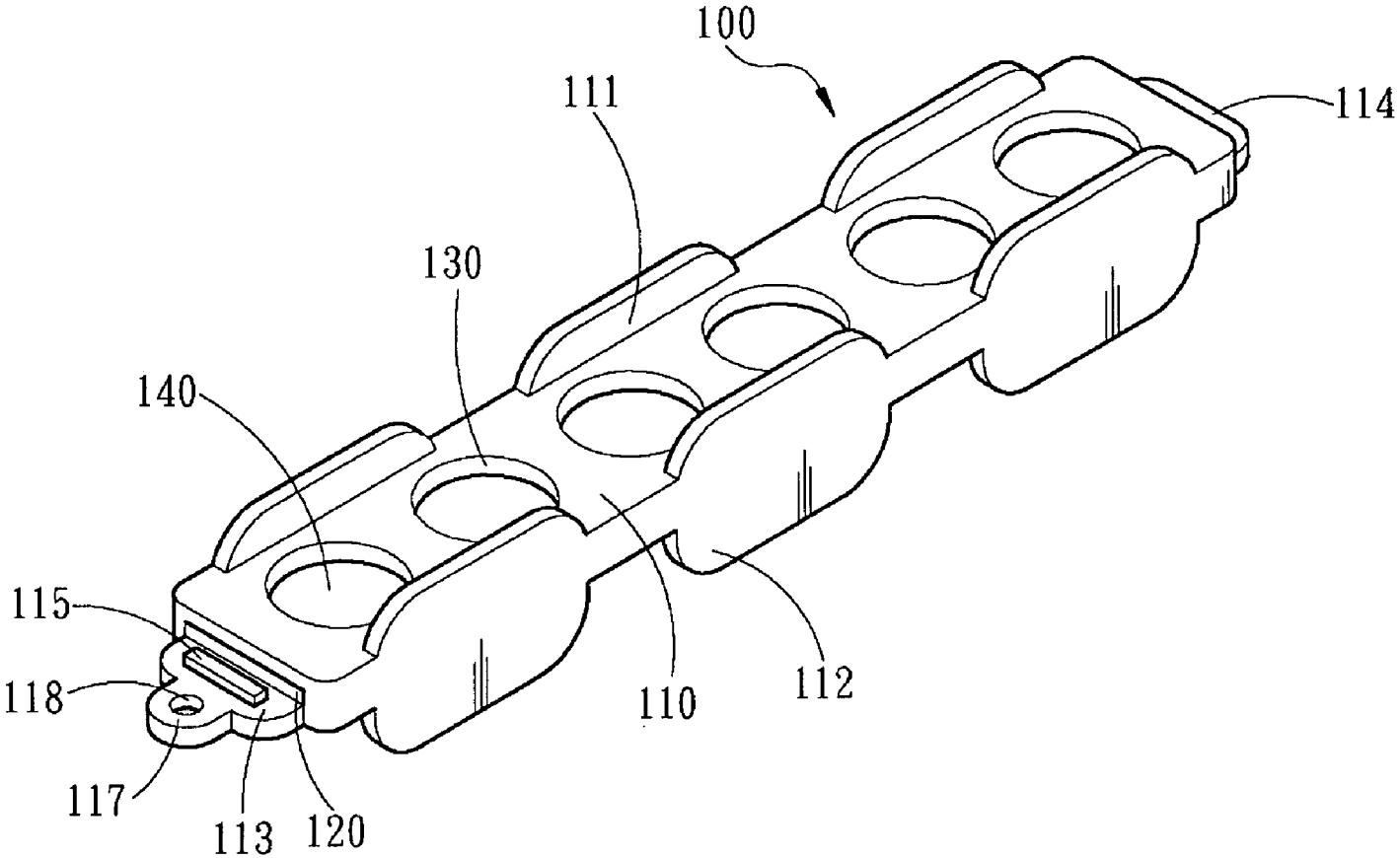
FIG. 1 is a perspective view of an embodiment of the fuel-saving apparatus of the invention.
Figure 2:
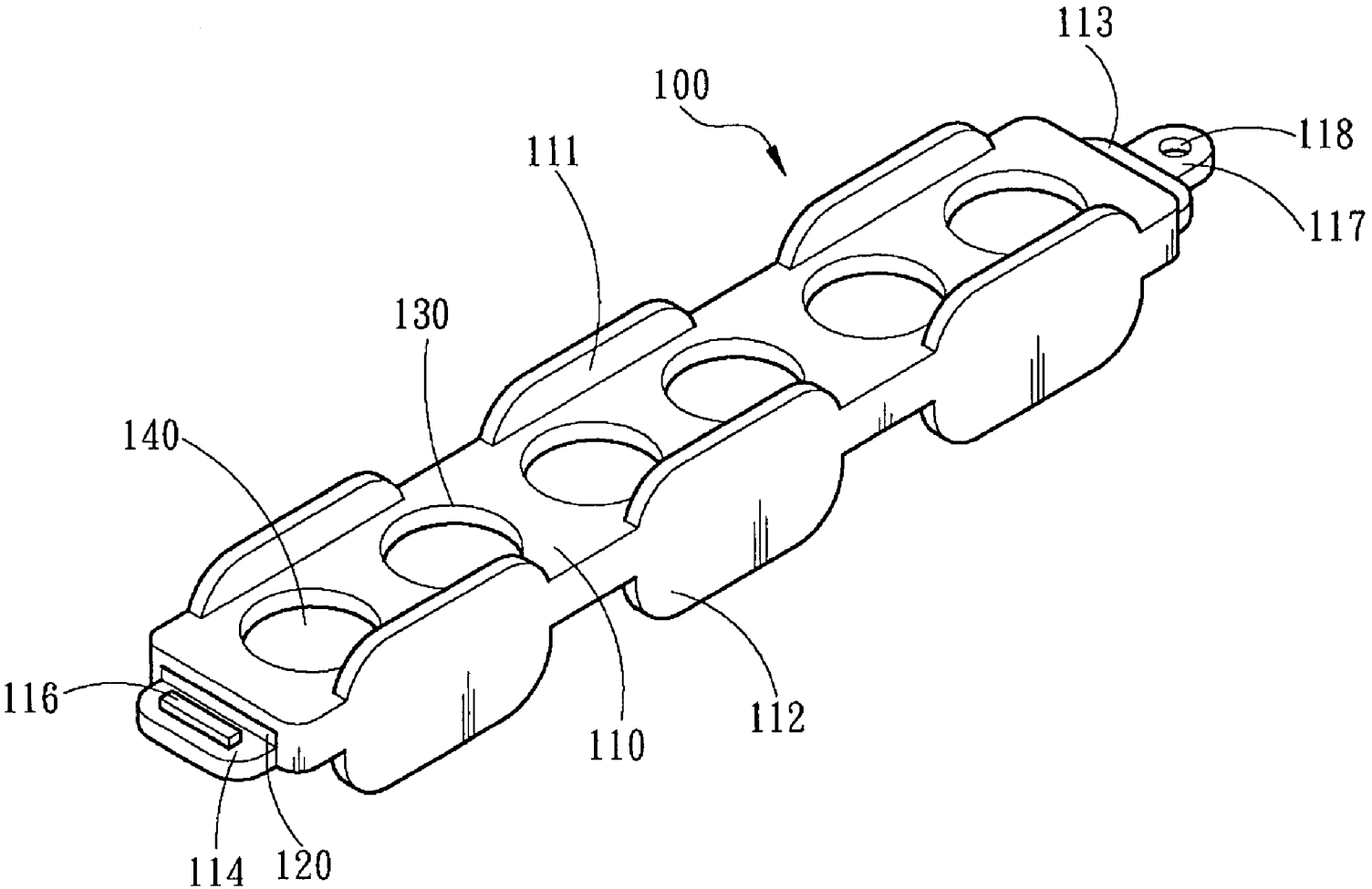
FIG. 2 is a schematic view of an embodiment of the fuel-saving apparatus of the invention seeing from a rear end.
Figure 3:
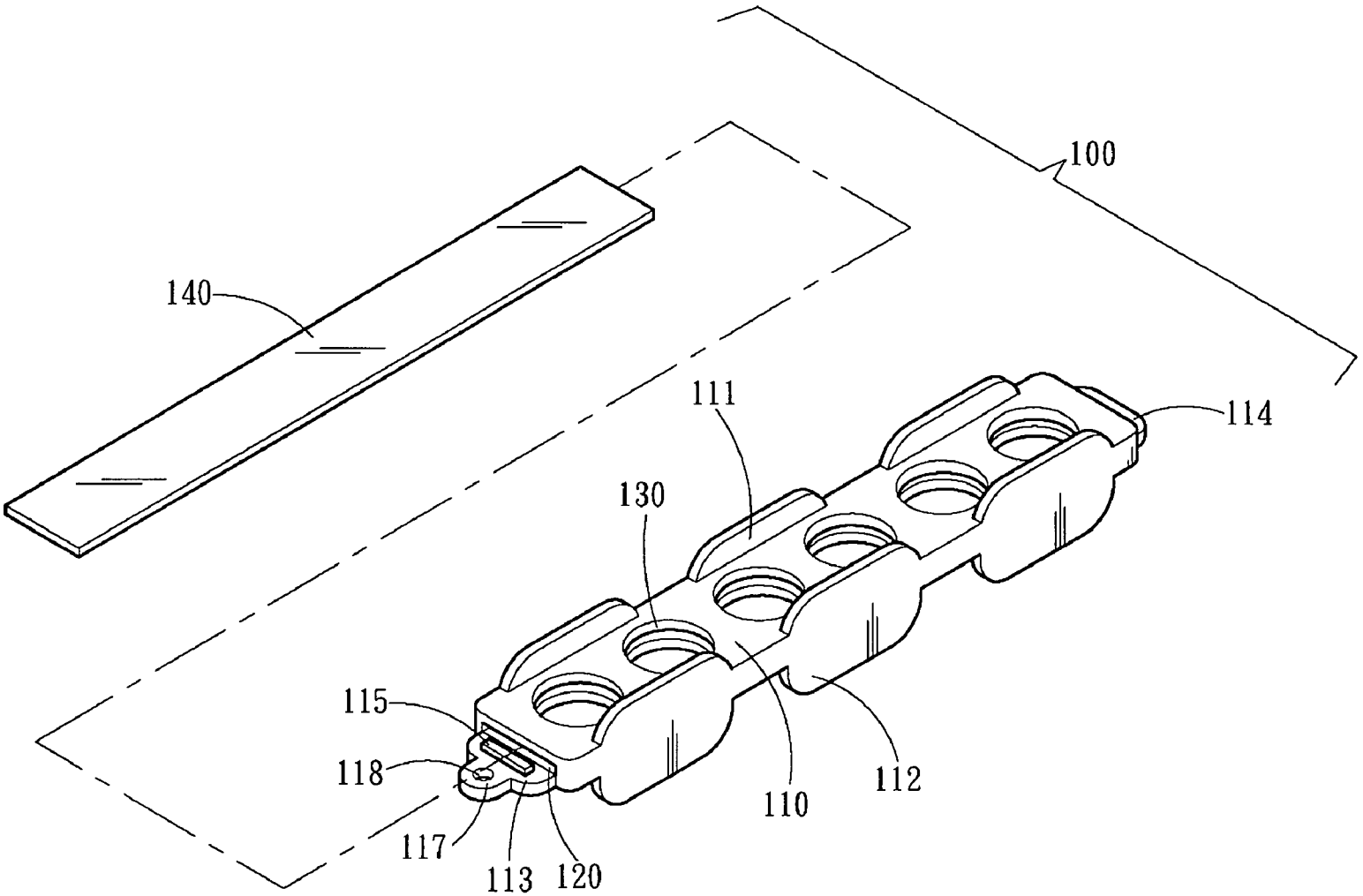
FIG. 3 is an exploded view of an embodiment of the fuel-saving apparatus of the invention.

Please refer to FIGS. 1, 2 and 3, a fuel-saving apparatus 100 of the invention includes an elongated and flattened body 110 made from a pliable and fuel-resistant material, such as silicon rubber. The body 110 has two ends each has a coupling slot 120, a plurality of openings 130 on the flattened surface thereof, a plurality of upper flanges 111 and lower flanges 112 at two lateral sides, and a base blade 140 with a membrane located on one surface thereof that can emit infrared light. The base blade 140 is wedged through the coupling slot 120 and encased by the body 110.

When in use, the body 110 and the base blade 140 are disposed in a fuel tank. Because of the upper and lower flanges 111 and 112, the flattened surface of the body 110 is not directly in contact with the inner wall of the fuel tank. Through the openings 130 formed at two surfaces of the body 110, the base blade 140 can emit infrared light to cut through fuel molecules to become smaller to enrich oxygen content. As a result, the energy level of the fuel in the fuel tank can be boosted to achieve almost complete combustion in engines. Ordinary road test results indicate that fuel-saving can reach 15%, and 20% on highways. Moreover, discharge of carbon oxides (COx), nitrogen oxides (NOx) and carbon hydrogen compounds (HC) also reduces up to 50%. The body 110 made from the pliable material is flexible, and can be easily installed on the fuel piping by users themselves. Installation is done by throwing it into the fuel tank. It is simple and easy.

The body 110 further has a respectively an extended portion 113 and 114 from a lower side of the coupling slot 120 at the two ends thereof. The extended portions 113 and 114 have respectively a detent ridge 115 and 116 on the surface to prevent the base blade 140 from sliding out through the coupling slot 120. One of the extended portion 113 and 114 (the extended portion 113 being taken as an example in the drawings) is extended further to form a protrusive hanging portion 117 with a hanging hole 118 formed thereon. Through the hanging portion 117, the body 110 can be tied to a fuel tank cap through an external article such as a rope by threading through the hanging hole 118. As the pliable body 110 is not directly in contact with the inner wall of the fuel tank due to the upper and lower flanges 111 and 112, the base blade 140 does not directly hit the inner wall of the fuel tank, and the risk of breaking the base blade 140 can be prevented.

Figure 4:
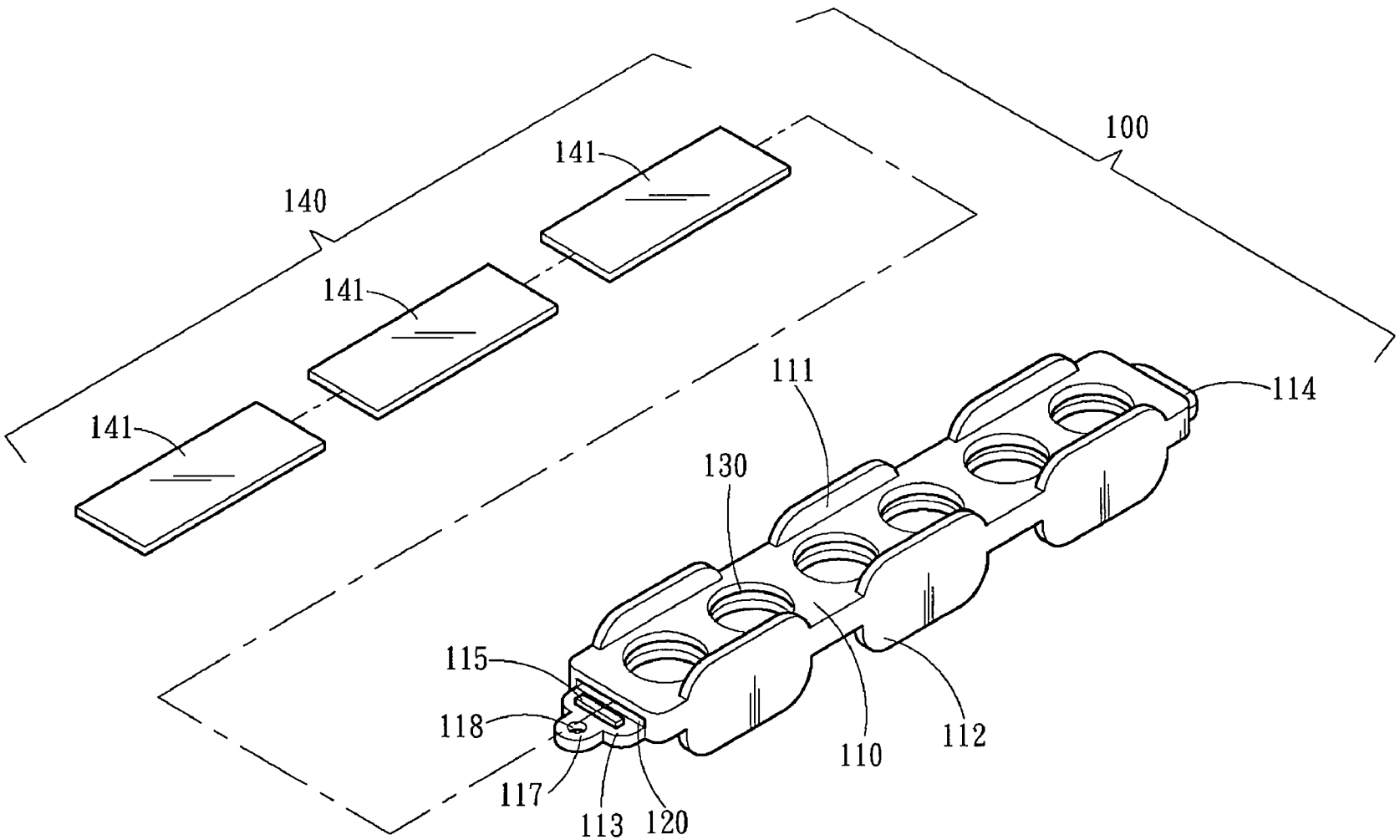
FIG. 4 is an exploded view of another embodiment of the fuel-saving apparatus of the invention.

Referring to FIG. 4, for a large fuel tank the piping connecting the fuel inlet and the fuel tank usually is formed in a straight manner. The body 110 holding the one piece base blade 140 previously discussed can be directly thrown into the fuel tank. However, for a smaller fuel tank, the piping connecting the fuel inlet and fuel tank usually is tortuous, hence directly throwing the body 110 with the one piece bade blade 140 attached thereon is not easy. To remedy this problem, the base blade 140 may be divided into a plurality of smaller base blades 141 of the same size. Three pieces of the smaller base blades 141 of the same size are shown in FIG. 4 as an example. Through the coupling slot 120, the smaller base blades 141 can be wedged through and encased by the pliable body 110. The body 110 thus formed can be bent flexibly according to the smaller base blades 141 to easily thread through the piping between the fuel inlet and the fuel tank. Thus it is adaptable to fuel tanks of varying fuel inlets without damaging the smaller base blades 141.

The invention has taken in account of easy installation. The base blade 140 can be protected by the pliable body 110. As the body 110 and the base blade 140 are solid and do not dissolve in the fuel, they can be used permanently. After being in contact with the fuel, it can cut through the fuel molecules to become smaller to enrich oxygen content. Hence the energy level of the fuel molecules in the fuel tank is boosted, and the fuel can achieve almost complete combustion in the engine. The power output by the engine increases, and the torque for uphill driving also is greater. The accelerator can be stepped with less effort. And fuel-saving can reach 15-20% or more. Discharge of waste gases such as carbon oxides (COx), nitrogen oxides (NOx) and carbon hydrogen compounds (HC) also reduces significantly. It is not only more environment friendly, carbon accumulation can be cleared more naturally, and engine efficiency and life span are higher, and noise and vibration are lower.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fuel-saving apparatus, comprising:

an elongated and flattened body made from a pliable material, the body having two ends each having a coupling slot, a plurality of openings and a plurality of upper flanges and lower flanges at two lateral sides thereof; and at least one base blade which has one surface attached to an infrared membrane and is wedged through the coupling slot to be encased by the body;

wherein the body is disposed in a fuel tank, the at least one base blade emitting infrared light through the openings to boost energy level of fuel molecules in the fuel tank to achieve almost complete combustion.

2. The fuel-saving apparatus of claim 1, wherein the two ends of the body have respectively an extended portion below the coupling slot and a detent ridge located on the surface of the extended portion to prevent the base blade from sliding out through the coupling slot.

3. The fuel-saving apparatus of claim 2, wherein one of the extended portions has a protrusive hanging portion which has a hanging hole formed thereon.

4. The fuel-saving apparatus of claim 1, wherein the at least one base blade includes a plurality of smaller base blades.

* * * * *